US006811277B2

(12) United States Patent
Amano

(10) Patent No.: US 6,811,277 B2
(45) Date of Patent: Nov. 2, 2004

(54) VEHICLE LAMP

(75) Inventor: Yasuyuki Amano, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/615,805

(22) Filed: Jul. 10, 2003

(65) Prior Publication Data

US 2004/0057244 A1 Mar. 25, 2004

(30) Foreign Application Priority Data

Jul. 10, 2002 (JP) ..... P.2002-201316

(51) Int. Cl.[7] ..... F21V 7/04

(52) U.S. Cl. ..... 362/31; 362/518; 362/297; 362/328; 362/329; 362/346

(58) Field of Search ..... 362/31, 517, 346, 362/297, 518, 520, 328, 329; 359/726, 459; 385/901, 133, 147

(56) References Cited

U.S. PATENT DOCUMENTS 5,054,885 A 10/1991 Melby et al.
5,700,078 A * 12/1997 Fohl et al. ..... 362/553
6,036,340 A * 3/2000 Fohl et al. ..... 362/511
6,097,549 A * 8/2000 Jenkins et al. ..... 359/726
6,347,874 B1 * 2/2002 Boyd et al. ..... 362/31
6,379,016 B1 * 4/2002 Boyd et al. ..... 362/31
6,576,887 B2 * 6/2003 Whitney et al. ..... 250/227.11

FOREIGN PATENT DOCUMENTS

DE 196 38 081 A1 9/1996

* cited by examiner

*Primary Examiner*—Thomas M. Sember
(74) *Attorney, Agent, or Firm*—Sughrue Mion, PLLC

(57) ABSTRACT

A vehicle lamp is constructed such that light exiting from an LED light source is converted into collimated light and such that the collimated light is reflected forward of the lamp by means of a reflector. At that time, the reflector portion has a stepwise reflection surface in which there are alternately formed a plurality of light incidence sections into which the collimated light enter and a plurality of intermediate sections into which no collimated light enters. Further, each of the intermediate sections is formed from an irregular surface formed so as to recess rearward of the lamp with respect to a plane parallel to the direction of radiation of the collimated light. By means of the irregular surface, stray light or the like included in the collimated light exiting from the optical member is reflected forward of the lamp. As a result, when the lamp is viewed from the front, the light incidence sections appear to glare, resembling spread spots, and the intermediate sections also appear to glare.

6 Claims, 10 Drawing Sheets

VEHICLE LAMP

BACKGROUND OF THE INVENTION

1. Field of the Invention

The present invention relates to a vehicle lamp equipped with an LED (light-emitting diode) light source. More particularly, the invention relates to a vehicle lamp geometrically configured such that its reflection surface reflects light in substantially a uniform manner.

2. Description of the Related Art

Many vehicle lamps equipped with an LED light source have recently been adopted. In this regard, German Patent Application Laid-Open No. 19638081 describes a vehicle lamp. The vehicle lamp is constituted such that light originating from an LED light source is converted into collimated light by means of a Fresnel lens such that the collimated light is reflected forward of a lamp by means of a reflector.

In the vehicle lamp described in the German publication, the reflector has a stepwise reflection surface in which there are alternately formed a plurality of light incidence sections where the collimated light exiting from the Fresnel lens enters and a plurality of plane-like intermediate sections where no collimated light enters. When the lamp is observed from the front thereof, the reflection surface of the reflector can be readily seen to be glaring over the entire surface at the reflection surface.

However, an intermediate section of the vehicle lamp described in the patent publication (where the collimated light exiting the Fresnel lens does not enter) becomes a non-illuminating section. Hence, the light incidence sections look glowing, resembling spread spots, but an intermediate section of the light incidence section looks dark. Thus, there arises a problem of a failure to make the reflection surface of the reflector glare in substantially a uniform manner.

SUMMARY OF THE INVENTION

The invention has been conceived under the foregoing circumstances and aims at providing a vehicle lamp which is equipped with an LED light source and can make a reflection surface of a reflector glare in substantially a uniform manner.

The invention attempts to achieve the foregoing object by designing the geometry of an intermediate section of a reflection surface.

The invention provides a vehicle lamp having a light source (in the embodiment, a LED light source), an optical member for converting light originating from the LED light source into collimated light, and a reflector portion for reflecting the collimated light exiting from the optical member forward of the lamp, wherein

- the reflector portion has a stepwise reflection surface in which there are alternately formed a plurality of light incidence sections into which the collimated light enters and a plurality of intermediate sections into which no collimated light enters; and
- at least a portion of the intermediate sections is formed from an irregular surface formed so as to recess rearward of the lamp with respect to a plane parallel to the direction of radiation of the collimated light.

Here, the term "vehicle lamp" is not limited to a vehicle lamp of specific type. For instance, a tail lamp, a stop lamp, or another lamp can be adopted.

In addition, no particular limitation is imposed on the specific configuration of the "optical member," so long as the optical member can convert the light originating from the LED light source into collimated light. For example, a Fresnel lens, a convex lens, or a concave mirror can be adopted. At that time, the "optical member" may or may not have another cross section for converting the light originating from the LED light source into collimated light, so long as the optical member is configured such that the light originating from the LED light source is converted into collimated light by-means of one cross sectional surface extending in the longitudinal direction of the lamp including the luminescent center of the LED light source.

The term "reflector portion" may denote an ordinary reflector portion configured to reflect the collimating light exiting from the optical member on an outer surface of the reflector portion. Alternatively, the reflector portion may be formed from a transparent member such that the collimated light exiting from the optical member having passed through the reflector portion is subjected to internal reflection.

In relation to the "reflection surface," no particular limitation is imposed on the arrangement of light incidence sections and intermediate sections, so long as a plurality of light incidence sections and a plurality of intermediate sections are formed stepwise and alternately.

No particular limitation is imposed on the specific geometry of the "light incidence section," so long as the light incidence section is formed so as to reflect the collimating light exiting from the optical member forward of the lamp. Further, there may be adopted a light incidence section configured to subject the collimated light exiting from the optical member to mere regular reflection. Alternatively, the light incidence section may be configured to subject the collimated light exiting from the optical member to diffusion and reflection.

The "irregular surface" constituting each intermediate section is not limited to any particular geometry, so long as the irregular surface is formed so as to recess rearward of the lamp with respect to a plane parallel to the direction of radiation of the collimated light exiting from the optical member.

As indicated by the foregoing configurations, the vehicle lamp of the invention is configured to convert the light originating from the LED light source into collimated light by means of an optical member. The collimated light exiting from the optical member is reflected forward of the lamp by means of a reflector. The reflector portion has a stepwise reflection surface in which there are alternately formed a plurality of light incidence sections into which the collimated light enters and a plurality of intermediate sections into which no collimated light enters. At least a portion of the intermediate sections is formed from an irregular surface formed so as to recess rearward of the lamp with respect to a plane parallel to the direction of radiation of the collimated light. Hence, the following working-effect can be obtained.

Specifically, in relation to the vehicle lamp equipped with the LED light source, generally the LED light source is optically designed as a point source of light. In effect, an illumination section of the LED light source has a somewhat light-emitting area, although the area is small. Further, a manufacturing error or a mount error inevitably arises in the optical member or the like. Consequently, the collimated light that originates from the optical member and enters the reflection surface of the reflector portion has some degree of broadness.

If at least a portion of the intermediate sections constituting the reflection surface is formed from an irregular surface, stray light (an oblique ray) included in the collimated light originating from the optical member can be reflected forward of the lamp by means of the irregular surface. As a result, when the lamp is observed from the front, the reflection surface of the reflector portion can be made such that the intermediate section formed from the irregular surface also appears to glow and also as such that the light incidence section appears to glow, resembling spread spots. At that time, the irregular surface constituting the intermediate section is formed so as to recess rearward of the lamp with respect to the plane parallel to the direction of radiation of the collimated light exiting from the optical member. As a result of the intermediate sections being formed from irregular surfaces, incidence of light onto the light incidence sections is not hindered.

According to the embodiment, in the vehicle lamp equipped with the LED light source, an area on the reflection surface of the reflect or portion where the intermediate section is formed from the irregular surface can be made to glare in substantially a uniform manner. At that time, as long as the intermediate section is formed from the irregular surface over the entire reflection surface of the reflector portion, the entire reflection surface of the reflector portion can be made to glare in substantially a uniform manner.

As mentioned previously, the specific geometry of the "irregular surface" is not limited to any specific geometry. If the cross-sectional profile of the irregular surface is set to a saw-toothed profile, the stray light included in the collimated light exiting from the optical member can be reflected forward of the lamp efficiently.

In the configuration, at least a portion of the reflection surface of the reflector portion is formed as an internal reflection section for reflecting the collimated light exiting the optical member forward of the lamp through internal reflection. At least the intermediate section located in the internal reflection section is formed from the irregular surface. As a result, the following working-effect can be yielded.

Specifically, the collimated light entering the internal reflection section travels through the reflector portion. Hence, the stray light included in the collimated light exiting the optical member enters the irregular surface of the intermediate section, and the collimated light exiting the optical member is also subjected to scattering by means of impurities or the like within the reflector portion. Stray light stemming from repeated internal reflection and stray light stemming from a portion of the light subjected to diffusion and reflection forward of the lamp by means of the light incidence section being internally reflected from the front surface of the internal reflection section enter the irregular surfaces of the intermediate section. Consequently, when the intermediate section located in the internal reflection section is formed from the irregular surface, the internal reflection section can appear to glare more brightly. As a result, the internal reflection section can be made to glare in substantially a uniform manner.

When at least a portion of the reflection surface of the reflector portion is formed as an internal reflection section, at least a part of the reflector portion is formed from a translucent member. In such a case, when the optical member is also formed from a translucent member, the translucent members can be formed as a single member.

DETAILED DESCRIPTION OF THE INVENTION

An embodiment of the invention will now be described herein below by reference to the drawings.

Figure 1:
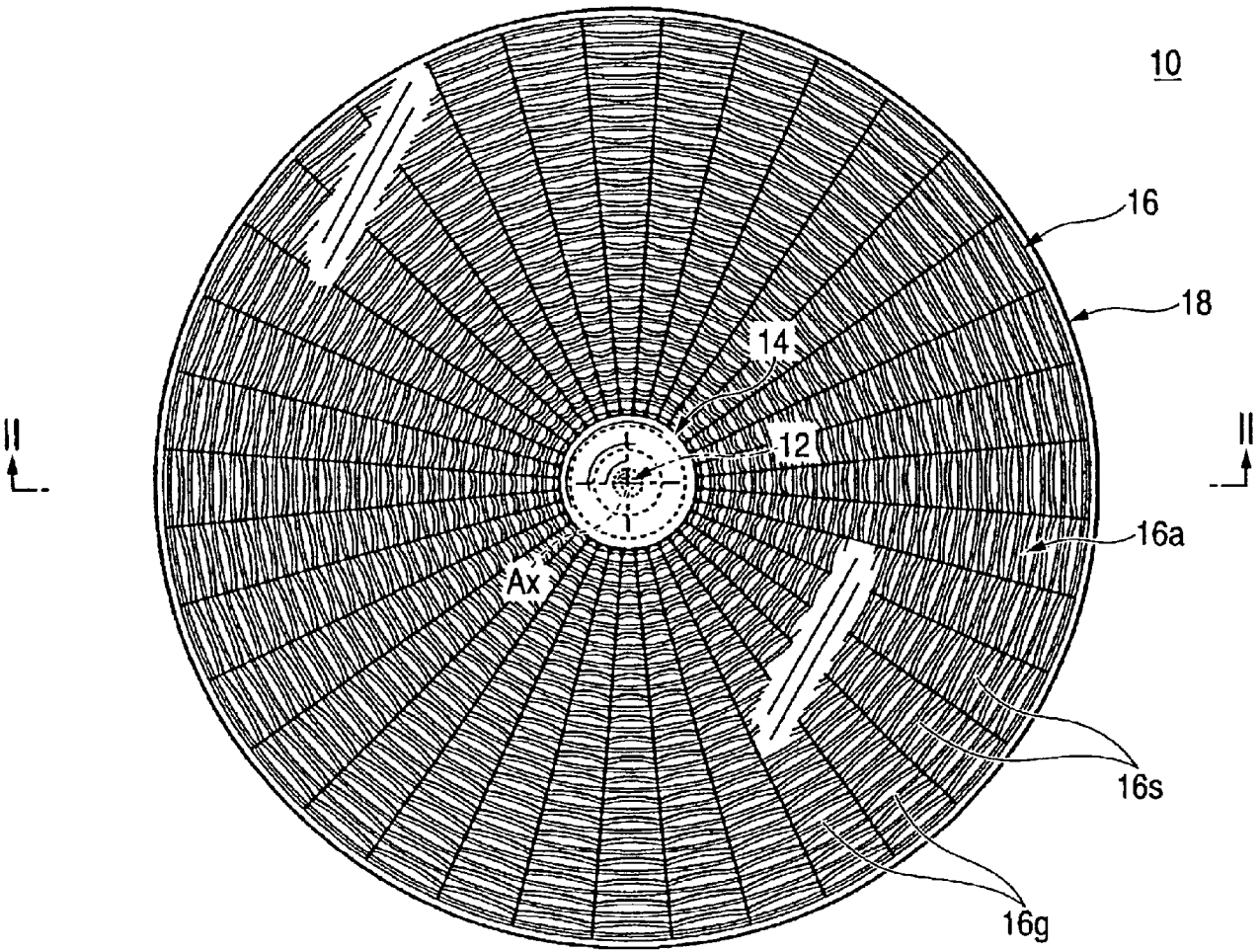
FIG. 1 is a front view showing a vehicle lamp of an embodiment of the invention.
Figure 2:
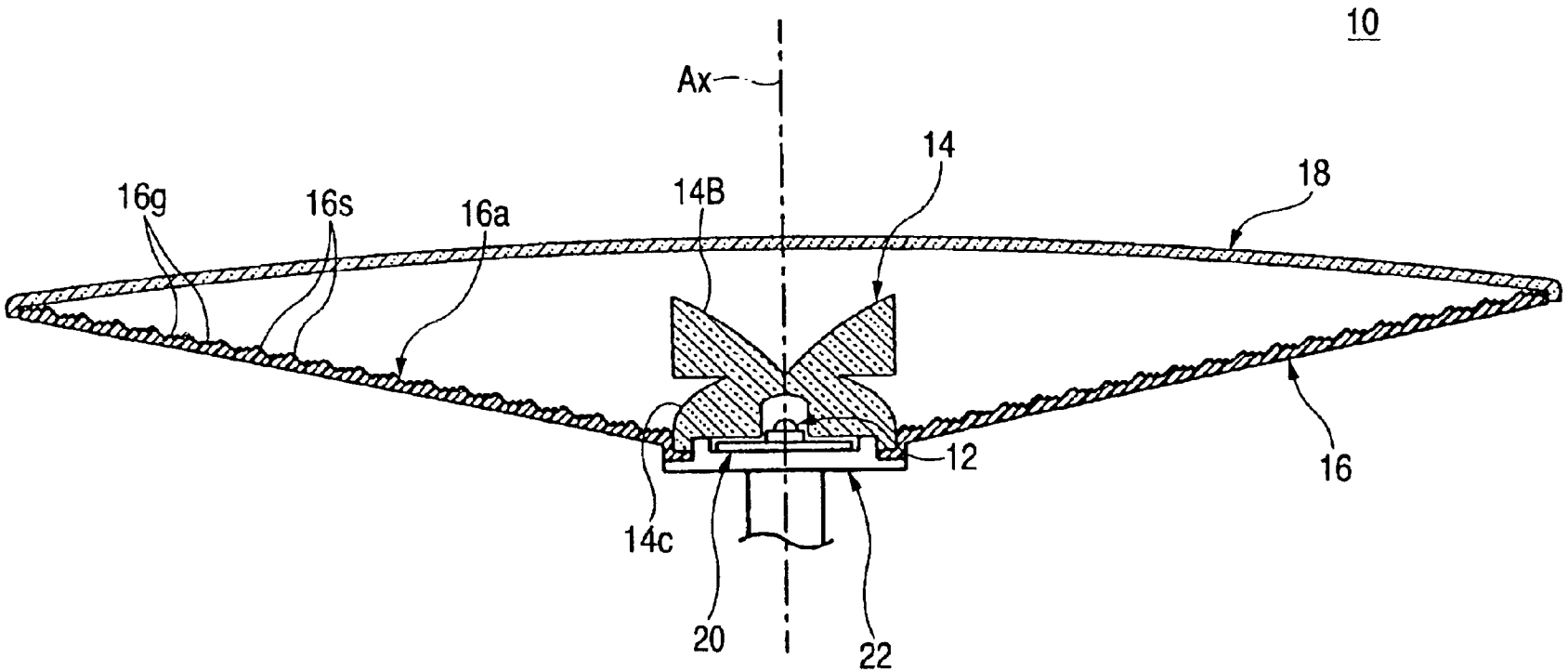
FIG. 2 is a cross-sectional view taken along line II—II shown FIG. 1.
Figure 3:
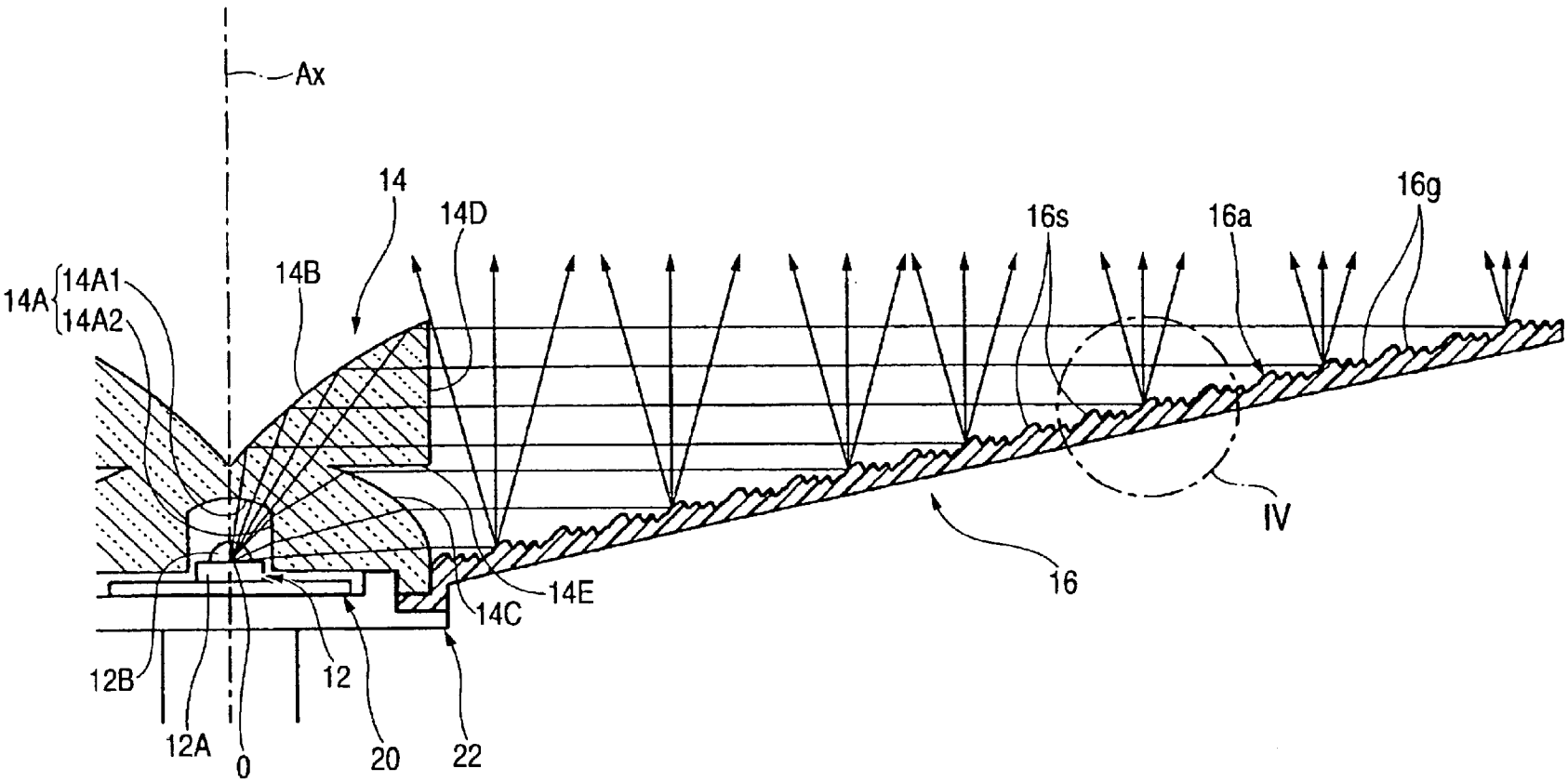
FIG. 3 is a detailed view of the featured section shown in FIG. 2.

FIG. 1 is a front view showing a vehicle lamp of an embodiment. FIG. 2 is a cross-sectional view taken along line II—II shown in FIG. 1. FIG. 3 is a detailed view of the featuring section shown in FIG. 2.

As illustrated, a vehicle lamp 10 of the embodiment is a tail lamp provided at a rear end section of the vehicle and comprises an LED light source 12, an optical member 14, a reflector portion 16, and a translucent cover 18.

The LED light source 12 is oriented forward of the lamp (i.e., in a rearward direction of a vehicle, and this applies to any counterparts in the following descriptions) such that an optical axis Ax is brought into alignment with the center axis of the lamp extending in a longitudinal direction of the vehicle. The LED light source 12 is formed from an LED main body 12A, and sealing plastic 12B which covers the luminescent center O of the LED main body 12A in a substantially semi-spherical manner. The LED light source 12 is fixed to a substrate support member 22 by way of a substrate 20.

The translucent member 14 is formed from a transparent synthetic resin molded product arranged so as to cover the LED light source 12 from the front. A rear surface section of the optical member 14 is secured on the substrate support member 22.

A light incidence recess 14A for causing the light originating from the LED light source 12 (hereinafter called "outgoing LED light") to enter the optical member 14 is formed in a rear surface of the optical member 14. The light incidence recess 14A has a spherical section 14A1 spherically surrounding the luminescent center O, and a cylindrical section 14A2 cylindrically surrounding the optical axis Ax. Of the outgoing LED light, a light ray going out of the LED at a small angle (specifically an angle of, e.g., 40° or less) with reference to the optical axis Ax travels through the optical member 14 without modifications after having entered the spherical section 14A1 at right angles. A light ray going out of the LED at a large angle (specifically an angle of, e.g., 40° or more) with reference to the optical axis Ax is refracted to travel toward an outer periphery of the optical member 14 therein after having obliquely entered the cylindrical section 14A2.

Formed on the surface of the optical member 14 are an internal reflection section 14B and a refraction section 14C. The internal reflection section 14B subjects small-angle incidence light (the light having entered the spherical section 14A1) that has entered the optical member 14 at a small angle with reference to the optical axis Ax to internal reflection in a direction substantially orthogonal to the optical axis Ax. The refraction section 14C refracts large-angle incident light (the light having entered the cylindrical section 14A2) that has entered the optical member 14 at a large angle with respect to the optical axis Ax in a direction substantially orthogonal to the optical axis Ax.

The internal reflection section 14B is formed in a front surface section of the optical member 14 and from a substantially-funnel-shaped rotary curved surface centered on the optical axis Ax. The refraction section 14C is formed from a substantially-annular-dome-shaped rotary curved surface centered on the optical axis Ax rearward of the internal reflection section 14B.

An area on the surface of the optical member 14 close to an outer periphery of the internal reflection section 14B is formed as a cylindrical outer peripheral section 14D made of a cylindrical surface centered on the optical axis Ax. As a result, the outgoing LED light that has undergone internal reflection on the internal reflection section 14B and travels in a direction substantially orthogonal to the optical axis Ax is caused to travel from the cylindrical outer peripheral section 14D along a straight line outside of the optical member 14 without modifications. A rear end section of the cylindrical outer peripheral section 14D is formed as an annular plane section 14E formed from a plane perpendicular to the optical axis Ax. As a result, the outgoing LED light ray that has been reflected by the internal reflection section 14B and the outgoing LED light ray that has been refracted by the refraction section 14C are prevented from being shielded by the annular plane section 14E.

The reflector portion 16 is arranged to reflect the outgoing LED light that has passed through the optical member 14 (i.e., the collimated light traveling in a direction substantially orthogonal to the optical axis Ax) forward of the lamp. The reflector portion 16 is formed from a synthetic resin product into a flat conical surface geometry, whose front surface is subjected to reflection surface treatment. When the lamp is viewed from the front, the reflector portion 16 in this embodiment has a circular outer shape.

The reflector portion 16 has a stepwise reflection surface 16*a*. In the reflection surface 16*a*, a plurality of light incidence sections 16*s*, into which the collimated light going out of the optical member 14 enters, and a plurality of intermediate sections 16*g*, into which the collimated light going out of the optical member 14 does not enter, are alternately formed. The light incidence sections 16*s* and the intermediate sections 16*g* are arranged at equal intervals so as to separate the reflection surfaces 16*a* radially and concentrically.

Each of the light incidence sections 16*s* is formed into a convex curved surface having a predetermined curvature in the radial and circumferential directions with respect to the optical axis Ax while a conical surface having the optical axis Ax is taken as a center axis and a vertical angle of 90° is taken as a reference surface. The collimated light going out of the optical member 14 is diffused and reflected in the radial and circumferential directions with respect to the optical axis Ax.

Each of the intermediate sections 16*g* is formed from an irregular surface so as to recess rearward of the lamp with respect to the plane orthogonal to the optical axis Ax. The irregular surface constituting each intermediate section 16*g* is formed from a plurality of V-shaped grooves, each having a saw-toothed cross-sectional profile and extending in a circumferential direction.

The translucent cover 18 is formed from a transparent synthetic resin molded product. When the lamp is viewed from the front, the translucent cover 18 has a circular outer shape. An outer edge of the translucent cover 18 is fixed to the reflector portion 16.

FIG. 3 shows the outgoing LED light passed through the optical member 14 as collimated light traveling in a direction substantially orthogonal to the optical axis Ax. This figure shows an optical path achieved when the light originating from the LED light source 12 goes out the luminescent center O serving as a point source of light and where the optical member 14 is accurately manufactured and attached to the substrate support member. In effect, an illumination section of the LED light source 12 has a light-emitting area of sorts, although the area is small. Further, occurrence of a manufacturing error or a mount error in the optical member 14 is inevitable. Consequently, the collimated light entering the reflection surface 16*a* of the reflector portion 16 from the optical member 14 has some degree of broadness. Moreover, the collimated light may deviate slightly from the direction substantially orthogonal to the optical axis Ax, depending on the mounting configuration and manufacturing tolerances.

Figure 4:
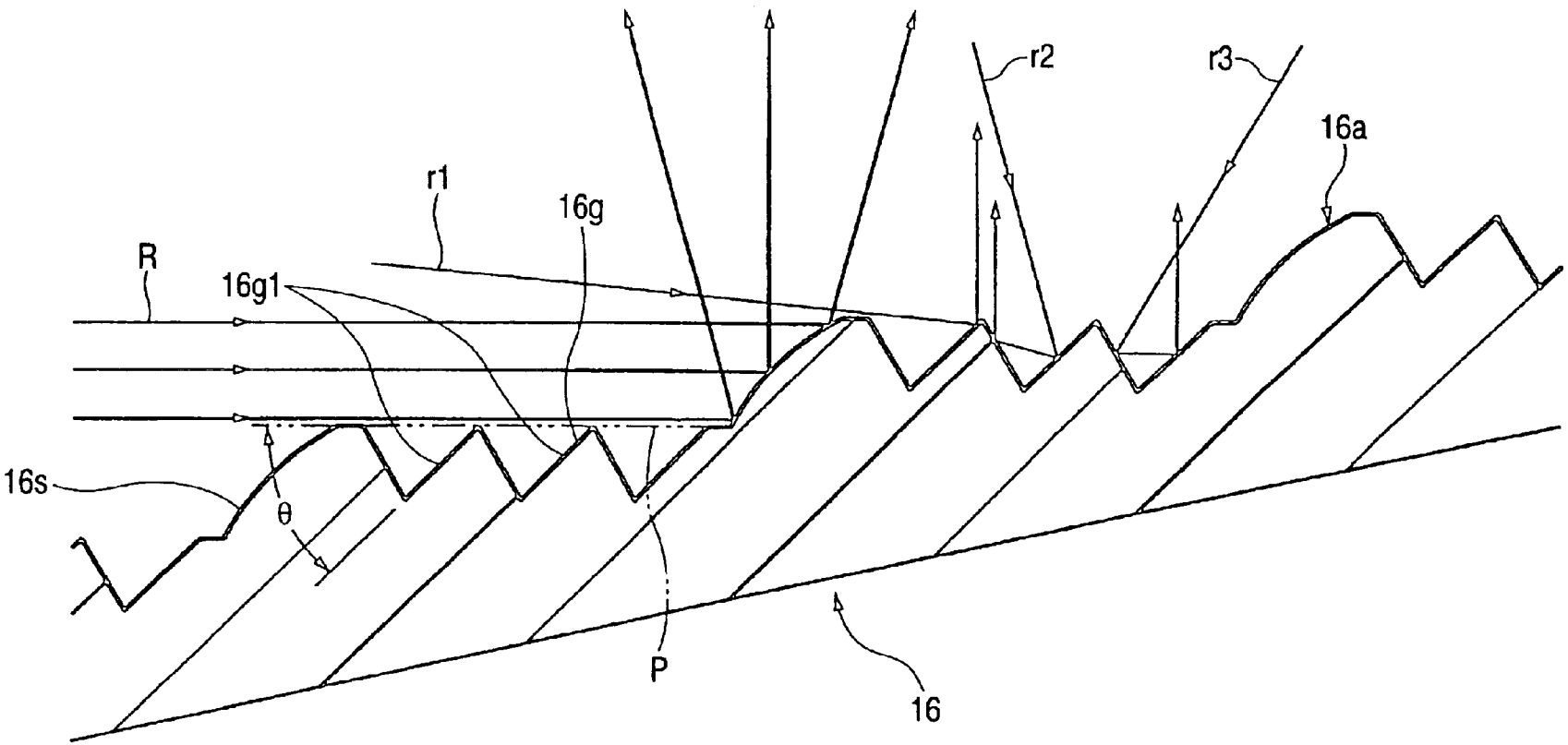
FIG. 4 is a detailed view of a section designed by IV shown in FIG. 3.

FIG. 4 is a detailed view of a section IV shown in FIG. 3.

As illustrated, an angle θ formed between an outer peripheral slope 16*g*1 of each V-shaped groove in an irregular surface constituting the intermediate section 16*g* and a plane P (a plane parallel to the direction in which the collimated light from the optical member 14 is radiated) orthogonal to the optical axis Ax is usually set to a value of about 40° to 45°.

Of the collimated light going out the optical member 14, a component R traveling in a direction orthogonal to the optical axis Ax (original collimated light) enters only the light incidence section 16*s*. Stray light (an oblique ray) r1, which is slightly different in angle from the collimated light, enters the intermediate section 16*g*. Since the intermediate section 16*g* is formed from an irregular surface, the stray light r1 having entered the intermediate section 16*g* is reflected forward of the lamp. Stray light rays (scattered light) r2, r3 other than the stray light r1 are subjected to reflection on the intermediate sections 16*g* twice, to thereby travel forward of the lamp. The stray light rays r2, r3 primarily develop as a result of a portion of the light having been diffused and reflected forward of the lamp by the light incidence section 16*s* being again subjected to reflection on the translucent cover 18.

Figure 5:
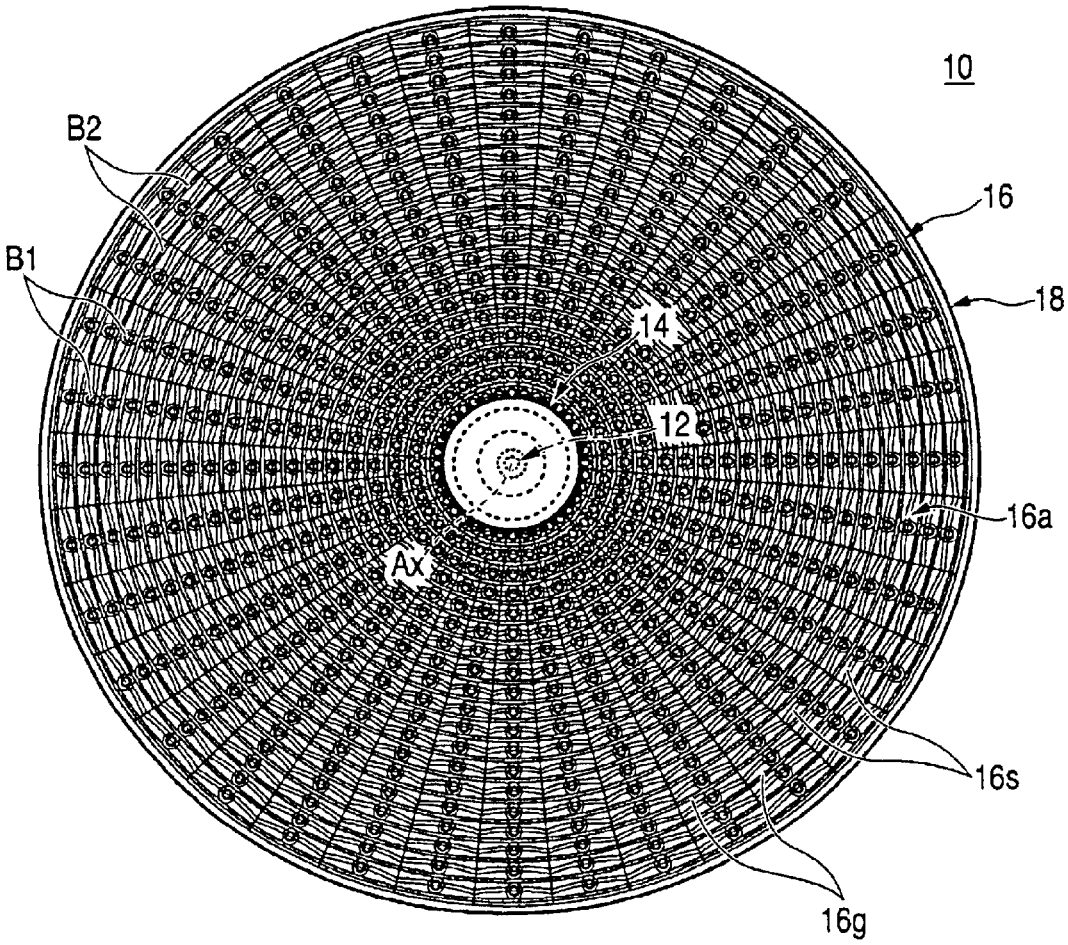
FIG. 5 is front view showing the vehicle lamp in an illuminated state.

FIG. 5 is a front view showing the vehicle lamp 10 of the embodiment with the LED light source 12 being illuminated.

As illustrated, when the vehicle lamp 10 is observed from the front, the plurality of light incidence sections 16*s* and the plurality of intermediate sections 16*g*, both constituting the reflection surface 16*a* of the reflector portion 16, simultaneously appear to glow discretely, resembling spread spots.

As mentioned above, each of the light incidence sections 16*s* is formed into a convex curved surface while a conical surface having the optical axis Ax is taken as a center axis and a vertical angle of 90° is taken as a reference surface. The outgoing LED light enters the respective light incidence sections 16*s* as collimated light. Center portions of the light incidence sections 16*s* appear to glow brightly as glaring sections B1. Even when the eyepoint has been slightly deviated from the front of the lamp, the outgoing LED light falls on the respective light incidence sections 16*s* as collimated light. Hence, the portions of the respective light incidence sections 16*s* deviated from the centers thereof appear to glow brightly as the glaring sections B1 in accordance with the amount of movement of the eyepoint.

As mentioned above, each of the intermediate sections 16*g* is formed from an irregular surface formed from a plurality of V-shaped grooves extending in a circumferential direction. The intermediate section 16*g* appears to glow as a narrow-ring-shaped glaring section B2. The stray light rays r1, r2, and r3 enter the respective intermediate sections 16*g*. However, the original collimated light R going out of the optical member 14 does not enter the intermediate sections 16*g*. Hence, the glowing section B2 becomes darker than the glowing section B1.

As has been described in detail, the vehicle lamp 10 of the embodiment is constructed such that the light originating from the LED light source 12 is converted into collimated light by means of the optical member 14 and such that the collimated light exiting the optical member 14 is reflected forward of the lamp by means of the reflector portion 16. The reflector portion 16 has a stepwise reflection surface 16*a*. In the stepwise reflection surface 16*a* there are alternately formed a plurality of light incidence sections 16*s* into which the collimated light enters and a plurality of intermediate sections 16*g* into which the collimated light does not enter. Each of the intermediate sections 16*g* is formed from an irregular surface formed so as to recess rearward of the lamp with respect to the plane parallel with the direction of radiation of the collimated light. By means of the irregular surfaces, the stray light r1 included in the collimated light exiting from the optical member 14 and the stray light rays r2, r3 reflected from the translucent member 18 can be reflected forward of the lamp.

When the lamp is observed from the front, the reflection surface 16*a* of the reflector portion 16 can be made such that the light incidence sections 16*s* appear to glow as the glaring sections B1, resembling spread spots, and such that the intermediate sections 16*g* formed from irregular surfaces also appear to glow as the glaring sections B2 concentrically and discretely. At that time, the irregular surfaces constituting the intermediate sections 16*g* are formed so as to recess rearward of the lamp with reference to the plane parallel to the direction of radiation of the collimating light exiting the optical member 14. As a result of the intermediate sections 16*g* being formed from irregular surfaces, incidence of light onto the light incidence sections 16*s* is not hindered.

As mentioned above, according to the embodiment, the entire reflection surface 16*a* of the reflector portion 16 can be made to glare in substantially a uniform manner.

Particularly in the embodiment, the irregular surface constituting the intermediate section 16*g* is set to a saw-toothed profile. Hence, the stray light r1 included in the collimated light exiting the optical member 14 can be efficiently reflected forward of the lamp. At that time, in the embodiment, the outer peripheral slope 16*g*1 of each V-shaped groove in the irregular surface is set to an angle of about θ=40° to 45° with respect to the plane P orthogonal to the optical axis Ax. Hence, the stray light r1 slightly deviating in angle from the direction orthogonal to the optical axis Ax can be reflected forward of the lamp. As a result, the brightness of the intermediate section 16*g* when viewed from the front of the lamp can be maximized.

In the embodiment, the reflection surface 16*a* of the reflector portion 16 is formed by subjecting the front surface of the reflector portion 16 to reflection surface treatment. However, the intermediate section 16*g* is formed from an irregular surface. Hence, even when paint for a purpose such as undercoating or the like has dropped during the course of reflection surface treatment, the paint or the like can be prevented from entering the irregular surface of the intermediate section 16*g*, to thereby hinder the paint from reaching the light incidence section 16*s*. As a result, impairment of the diffusion/reflection function of the light incidence section 16*s* can be inhibited effectively.

A first modification of the embodiment will now be described.

Figure 6:
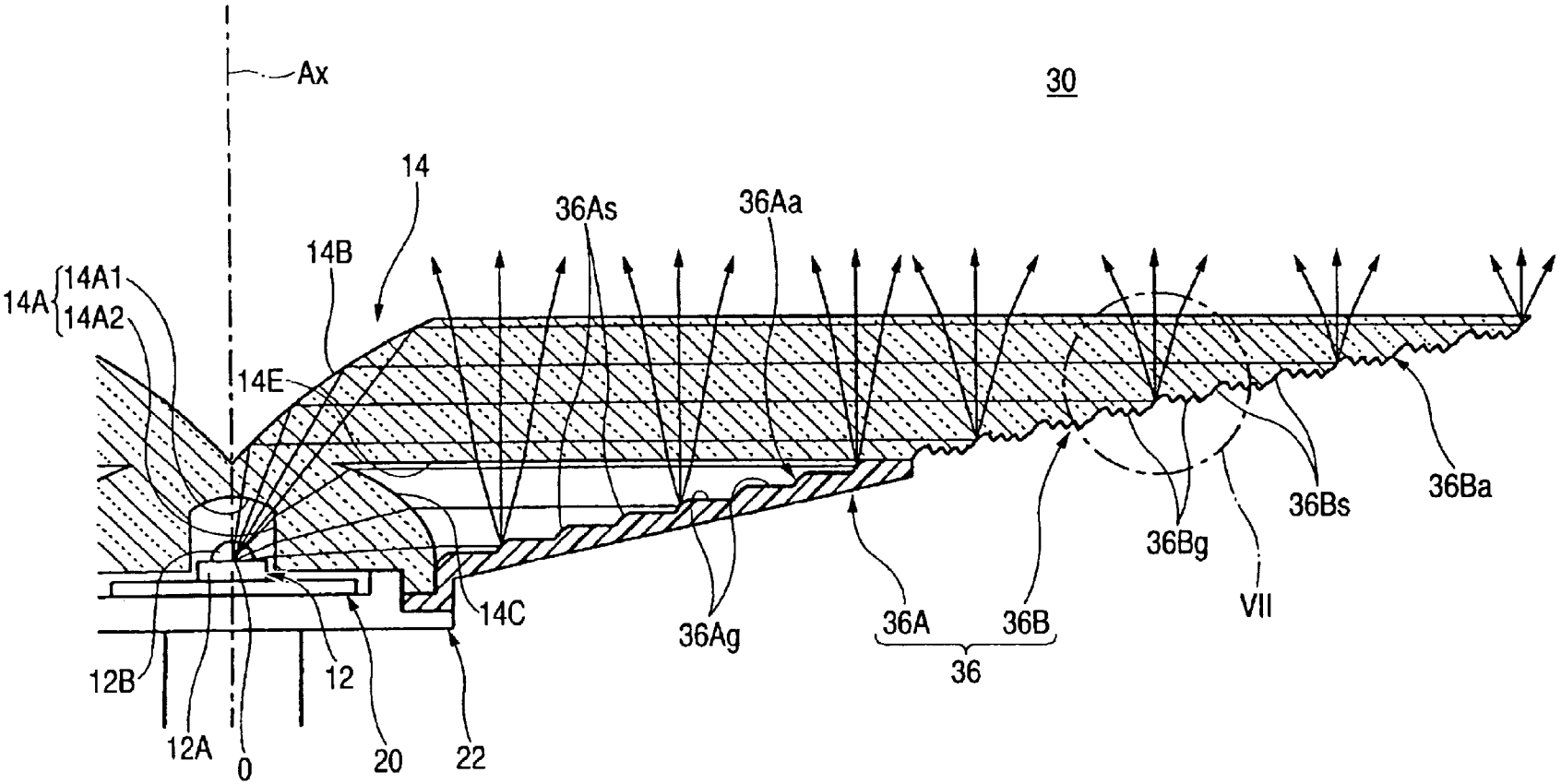
FIG. 6 is a view similar to FIG. 3, showing a vehicle lamp of a first modification.

FIG. 6 is a view analogous to FIG. 3, showing a vehicle lamp 30 of the modification.

As illustrated, the vehicle lamp 30 differs from the vehicle lamp 10 of the embodiment in the configuration of a reflector portion 36 and in that the translucent cover 18 is not provided.

A portion of the reflector portion 36 of the vehicle lamp 30 close to the inner periphery, into which the outgoing LED light exiting the refraction section 14C of the optical member 14 enters, and a portion of the reflector portion 36 of the vehicle lamp 30 close to the outer periphery, into which the outgoing LED light exiting the internal reflection section 14B of the optical member 14 enters, are formed as an internal reflection reflector section 36B.

The normal reflector section 36A is substantially identical in structure with the portion of the reflector portion 16 of the embodiment close to the inner periphery. Namely, the reflector portion 36 has a stepwise reflection surface 36Aa. Formed alternately in the reflection surface 36A a area plurality of light incidence sections 36As into which the collimated light exiting from the refraction section 14C of the optical member 14 enters, and a plurality of intermediate sections 36Ag into which no collimated light enters. In the modification, the intermediate sections 36Ag are formed not as irregular surfaces but of a plane orthogonal to the optical axis Ax.

The internal reflection reflector section 36B is configured to reflect the outgoing LED light having passed through the optical member 14 forward of the lamp through internal reflection. Namely, the internal reflection reflector section 36B is formed integrally with the optical member 14 such that the optical member 14 extends from the cylindrical outer peripheral section 14D (see FIG. 3) in the direction of an outer periphery. A reflection surface 36Ba is formed in an outer peripheral end surface. The reflection surface 36Ba is formed from a plurality of light incidence sections 36Bs into which the collimated light exiting the internal reflection section 14B of the optical member 14 enters and a plurality of intermediate sections 36Bg into which no collimated light enters, the sections being formed stepwise and alternately.

Figure 7:
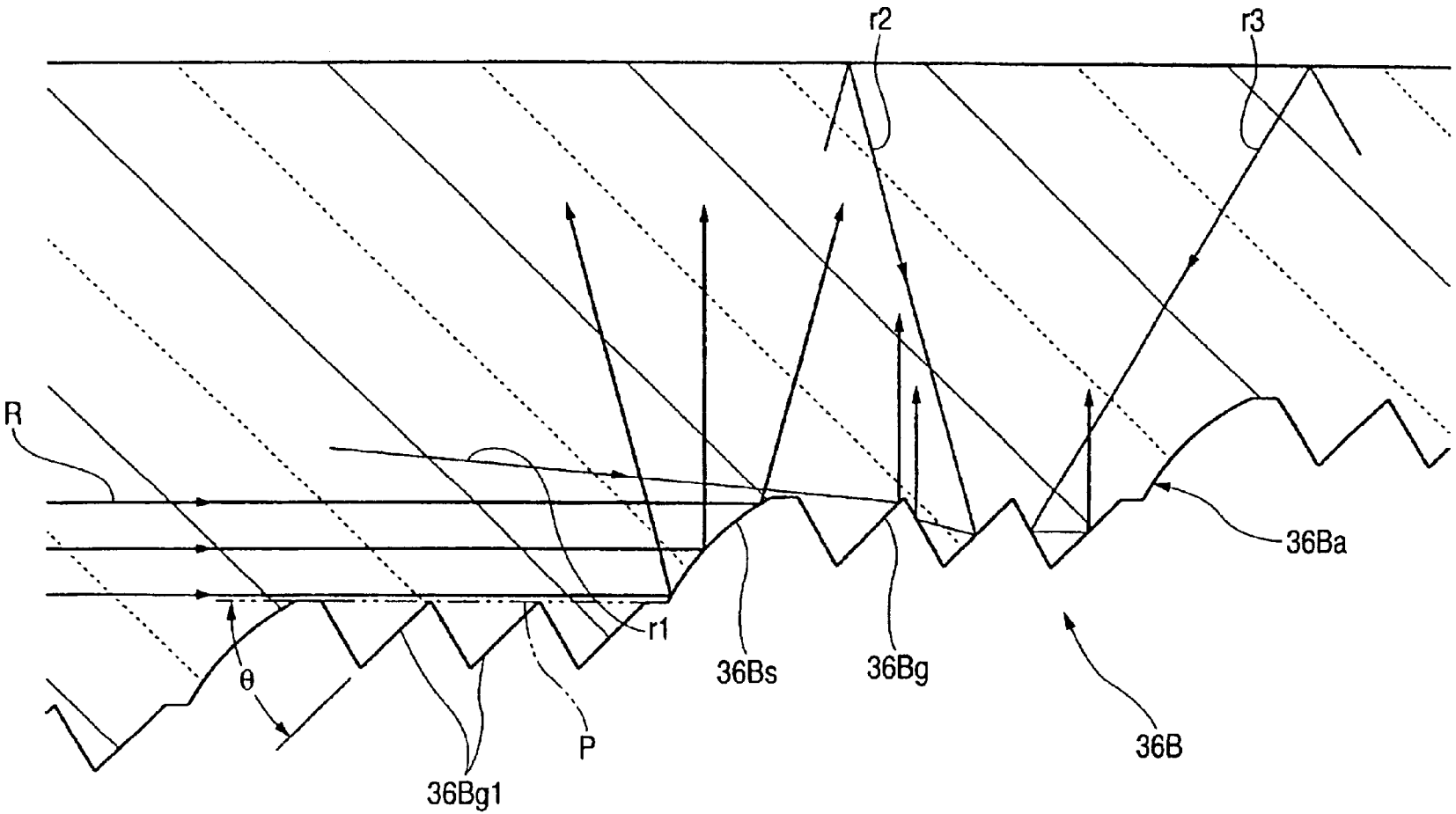
FIG. 7 is a detailed view of a section VII shown in FIG. 6.

FIG. 7 is a detailed view of a section marked VII in FIG. 6.

As illustrated, the intermediate sections 36Bg constituting the reflection surface 36Ba of the internal reflection reflector section 36B are formed from an irregular surface formed so as to recess rearward of the lamp with respect to the plane P parallel to the direction of radiation of the collimated light exiting from the optical member 14. An outer-peripheral-side slope 36Bg of each V-shaped groove in the irregular surface is set to an angle of about θ=40° to 45° with reference to the plane P orthogonal to the optical axis Ax.

Of the collimated light exiting from the internal reflection section 14B of the optical member 14, a component R (original collimated light) traveling in a direction orthogonal to the optical axis Ax enters solely the light incidence section 36Bs. The stray light (an oblique ray) r1 slightly deviating in angle from the collimated light enters the intermediate section 36Bg. The intermediate section 36Bg is formed from an irregular surface, and hence the stray light r1 having entered the intermediate section 36Bg is reflected forward of the lamp. Stray light rays (scattered light) r2, r3 other than the stray light r1 are subjected to reflection on the intermediate sections 36Bg twice, to thereby travel forward of the lamp. The stray light rays r2, r3 primarily develop as a result of a portion of the light diffused and reflected forward of the lamp by the light incidence section 36Bs being subjected to reflection on the front surface of the internal reflection section 14B and as a result of the collimated light output from the optical member 14 being subjected to repeated scattering and internal reflection by means of impurities or the like within the internal reflection reflector section 36B.

Figure 8:
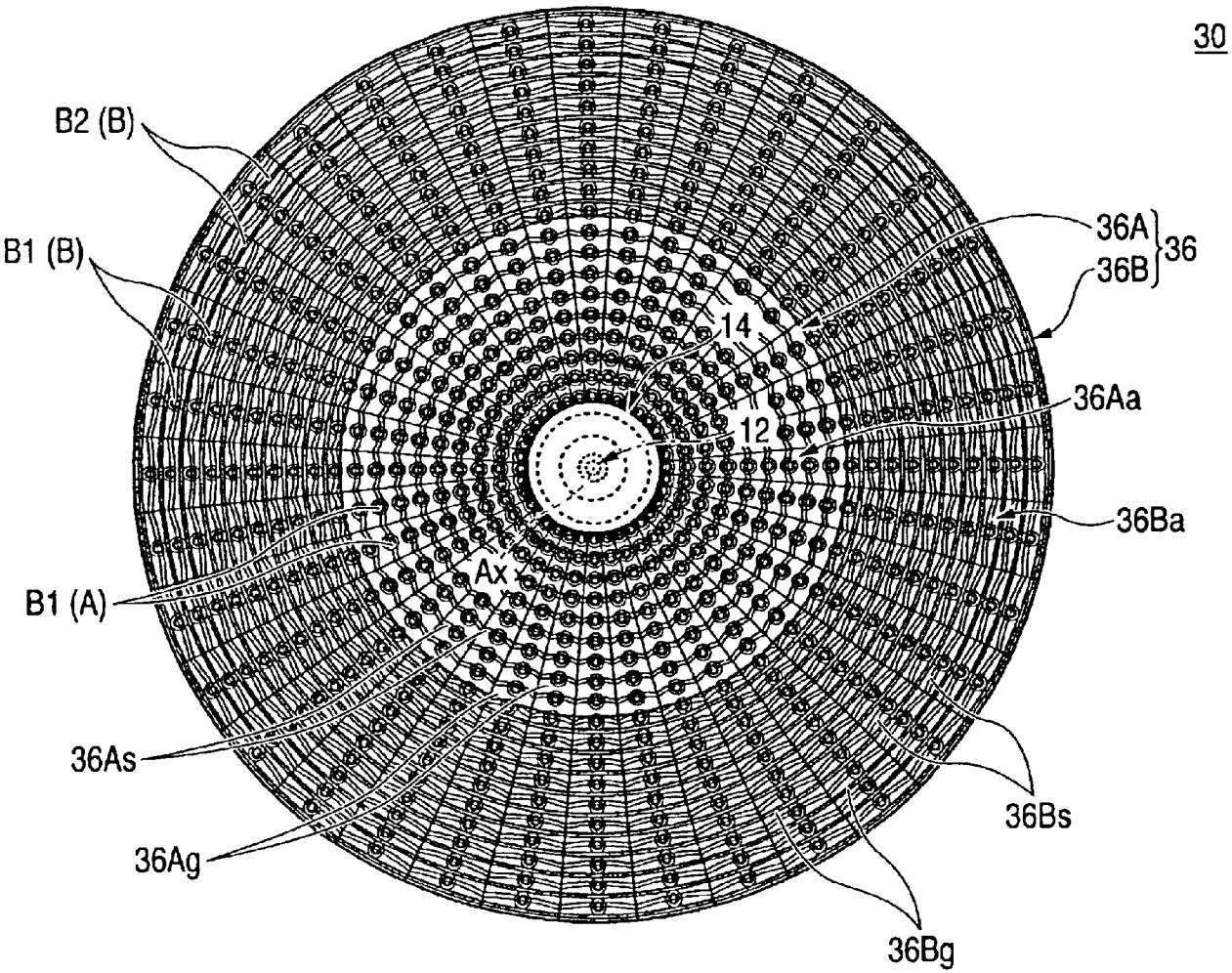
FIG. 8 is a front view showing the vehicle lamp of the first modification in an illuminated state.

FIG. 8 is a front view showing the vehicle lamp 30 of the present modification while the LED light source 12 is illuminated.

As illustrated, when the vehicle lamp 30 is observed from the front, the plurality of light incidence sections 36As and the plurality of intermediate sections 36Bs, both constituting the reflection surfaces 36Aa, 36Ba of the reflector portion 36, and the plurality of intermediate sections 36Bg constituting the reflection surface 36Ba of the internal reflection reflector section 36B simultaneously appear to glow discretely, resembling spread spots.

As mentioned above, each of the light incidence sections 36As, 36Bs is formed into a convex curved surface while a conical surface having the optical axis Ax is taken as a center axis and a vertical angle of 90° is taken as a reference surface. The outgoing LED light enters the respective light incidence sections 36As, 36Bs as collimated light. Center portions of the light incidence sections 36As, 36Bs appear to glow brightly as glaring sections B1 (A), B1 (B). Even when the eye or viewpoint has been slightly deviated from the front of the lamp, the outgoing LED light falls on the respective light incidence sections 36As, 36Bs. Hence, the portions of the respective light incidence sections 36As, 36Bs deviated from the centers thereof appear to glow brightly as the glaring sections B1 (A), B1 (B) in accordance with the amount of movement of the eyepoint.

Each of the intermediate sections 36Bg constituting the reflection surface 36Ba of the internal reflection reflector section 36B is formed from an irregular surface formed from a plurality of V-shaped grooves extending in a circumferential direction. The intermediate sections 36Bg appear to glow as a narrow-ring-shaped glaring section B2 (B). The stray light rays r1, r2, and r3 enter the respective intermediate sections 36Bg. However, the original collimated light R going-out of the optical member 14 does not enter the intermediate sections 36Bg. Hence, the glowing section B2 (B) becomes darker than the glowing sections B1 (A), B1 (B). The stray light rays r2, r3 are produced by repeated internal reflection. Hence, the stray light r2, r3 becomes greater in quantity than in the embodiment. For this reason, the glaring section B2 (B) becomes brighter than the glaring section B2 of the embodiment.

The respective intermediate sections 36Ag constituting the reflection surface 36Aa of the normal reflector section 36A are formed from a plane orthogonal to the optical axis Ax and hence appear dark.

When the configuration of the modification is adopted, the entire reflection surface 36Ba of the internal reflection reflector section 36B can be made to be glaring substantially uniform. At that time, the glaring section B2 (B) appears to glare more brightly than the glaring section B2 of the embodiment. Hence, the brightness of the reflection surface 36Ba can be made more uniform.

In the modification, only the glaring section B1 (A) of the reflection surface 36Aa of the normal reflector section 36A appears to glare brightly. The way in which the reflection surface 36Aa of the normal reflector section 36A is viewed can be made to contrast with the way the reflection surface 36Ba of the internal reflection reflector section 36B is viewed. As a result, novelty can be imparted to the design of the lamp that is required at the time of illumination.

A second modification of the embodiment will now be described.

Figure 9:
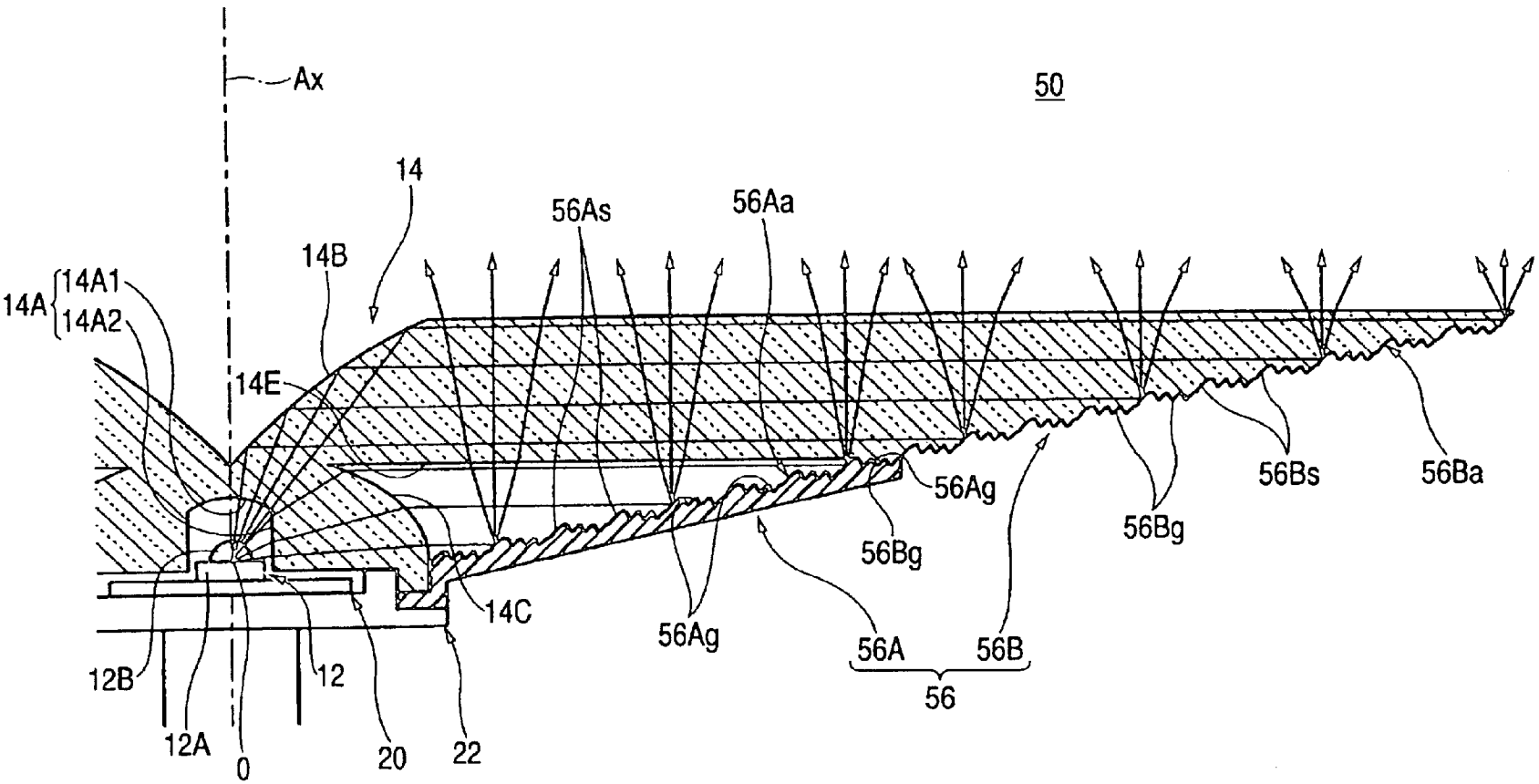
FIG. 9 is a view similar to FIG. 3, showing a vehicle lamp of a second modification.

FIG. 9 is a view similar to FIG. 3, showing a vehicle lamp 50 of the modification.

As illustrated, the vehicle lamp 50 is analogous in basic configuration to the vehicle lamp 50 of the first modification. A portion of the configuration of the reflector portion 56 is different from the first modification.

As in the case of the portion of the reflector portion 16 of the embodiment close to the inner periphery, the normal reflector section 56A of the reflector portion 56 of the present modification has a stepwise reflection surface 56Aa. Formed alternately in the reflection surface 56Aa are a plurality of light incidence sections 56As into which the collimated light exiting from the refraction section 14C of the optical member 14 enters and a plurality of intermediate sections 56Ag into which no collimated light enters. Each of the intermediate sections 56Ag is formed from an irregular surface.

As in the case of the internal reflection reflector section 36B of the first modification, the internal reflection reflector section 56B of the reflector portion 56has a stepwise reflection surface 56Ba. Formed alternately in the reflection surface 56Ba are a plurality of light incidence sections 56Bs into which the collimated light exiting from the refraction section 14B of the optical member 14 enters and a plurality of intermediate sections 56Bg into which no collimated light enters. An intermediate section 56Bg which meshes with the intermediate section 56Ag situated at the outer edge of the reflection surface 56Aa of the normal reflector section 56A is formed in an internal peripheral section of the reflection surface 56Ba.

Figure 10:
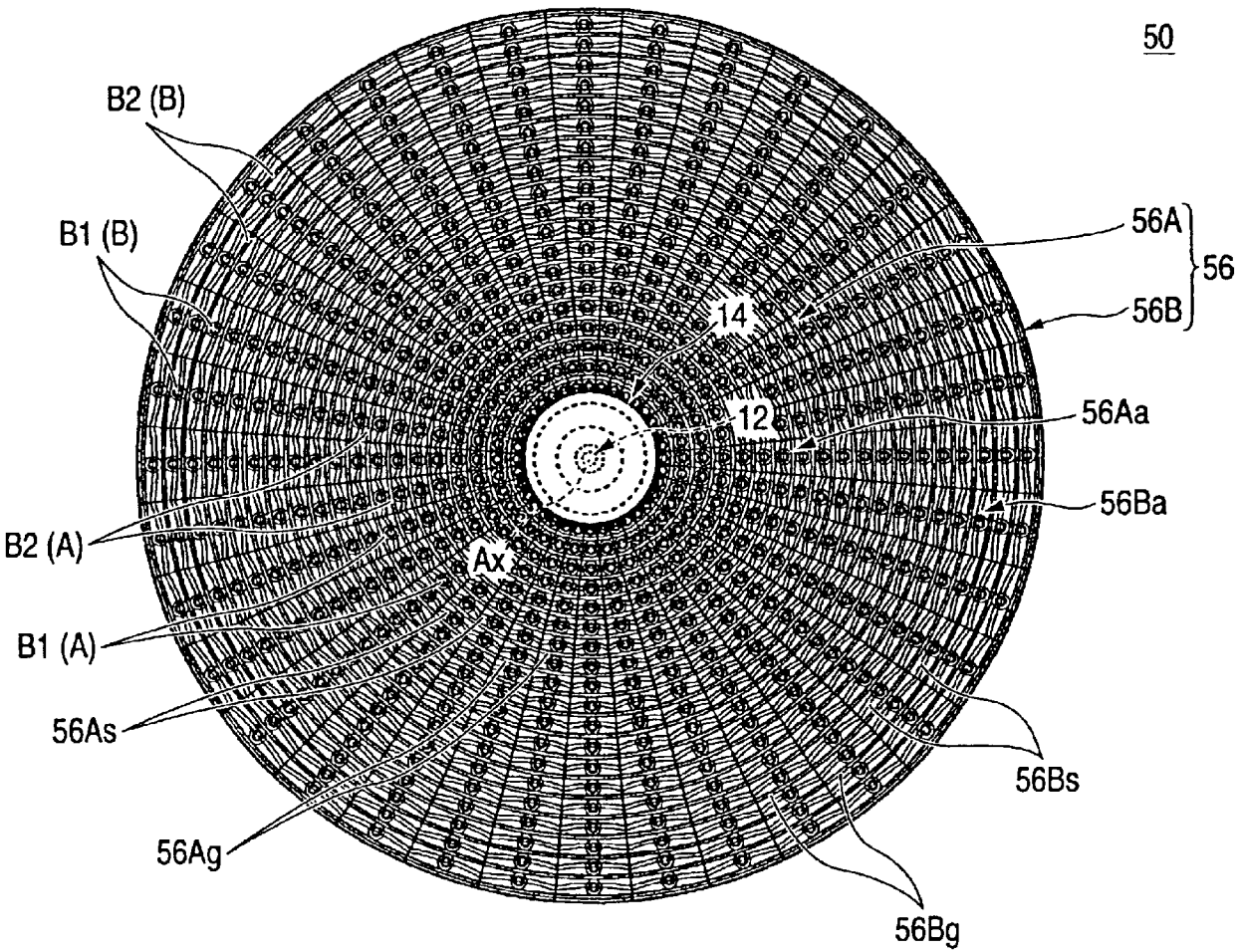
FIG. 10 is a front view showing the vehicle lamp of the second modification in an illuminated state.

FIG. 10 is a front view of the vehicle lamp 50 of the modification while the LED light source 12 is illuminated.

As illustrated, when the vehicle lamp 50 is observed from the front, the plurality of light incidence sections 56As and the plurality of intermediate sections 56Ag, both constituting the reflection surfaces 56Aa of the normal reflector section 56A, and the plurality of intermediate sections 56Bs and the intermediate sections 56Bg, both constituting the reflection surface 56Ba of the internal reflection reflector section 56B, simultaneously appear to glow discretely, resembling spread spots.

At that time, in relation to the reflection surface 56Aa of the normal reflector section 56A, a center section of each light incidence section 56As appears to glare brightly as the glaring section B1 (A). Each of the intermediate sections 56Ag appears to glare as a narrow-ring-shaped glaring section B2 (A). However, the manner in which the glaring section B1 (A) is viewed and the manner in which the glaring section B2 (A) is viewed are substantially the same as in the embodiment. In contrast, in relation to the reflection surface 56Ba of the internal reflection reflector section 56B, a center section of each light incidence section 56Bs appears to glare brightly as the glaring section B1 (B), and each of the intermediate sections 56Bg appears to glare as a narrow-ring-shaped glaring section B2 (B). The manner in which the glaring section B1 (B) is viewed and the manner in which the glaring section B2 (B) is viewed are substantially the same as in the case of the first modification.

When the configuration of the modification is adopted, the entire reflection surface 56Aa of the normal reflector section 56A as well as the entire reflection surface 56Ba of the internal reflection reflector section 56B can be made to glare in substantially a uniform manner. At that time, the glaring section B2 (B) of the modification is viewed slightly brighter than the glaring section B2 (B) of the embodiment. Hence, the manner in which the reflection surface 56Aa of the normal reflector section 56A is viewed can be made to contrast with the manner in which the reflection surface 56Ba of the internal reflection reflector portion 56B is viewed. As a result, novelty can be imparted to the design of the lamp that is required at the time of illumination.

In each of the modifications, the reflection surfaces 36Ba, 56Ba of the internal reflection reflector sections 36B, 56B are formed so as to reflect the collimated light exiting from the optical member 14 forward of the lamp through internal reflection. The rear surfaces of the internal reflection reflector sections 36B, 56B may be subjected to reflection surface treatment. In such a case, all the stray light rays r1, r2, and r3 entering the intermediate sections 36Bg, 56Bg can be reflected forward of the lamp, thereby rendering the glaring section B2 (B) brighter.

In the vehicle lamps 30, 50 of the modifications, provision of the translucent cover 18, such as that employed in the vehicle lamp 10 of the embodiment, is not required. However, in view of prevention of staining of the lamp, the translucent cover 18 may be provided.

In the embodiment and the respective modifications, the vehicle lamps 10, 30, 50 may be formed so as to be housed in a lamp chamber as a lamp unit, wherein the lamp chamber is formed from a translucent cover (outer cover) and a lamp body. In such a case, the translucent cover 18 may not be provided on the lamp.

In the embodiment and the modifications, the LED light source 12 is described as being oriented forward of the lamp. However, the LED light source may be arranged in another direction. Even in such a case, as a result of adoption of configurations analogous to those of the embodiment and the modifications, working-effects which are the same as those achieved by the embodiment and the modifications can be yielded.

The embodiment and the respective modifications have described cases where the vehicle lamps 10, 30, 50 are tail lamps. However, even in the case of a vehicle lamp other than the tail lamp (e,g., a stop lamp, a tail/stop lamp, a clearance lamp, and a turning signal), working-effects which are the same as those achieved by the embodiment and the modifications can be yielded as a result of adoption of configurations analogous to those of the embodiment and the modifications.

What is claimed is:

1. A vehicle lamp comprising a light source, an optical member for converting light originating from the light source into collimated light, and a reflector portion for reflecting the collimated light exiting from the optical member forward of the lamp, wherein the reflector portion includes a stepwise reflection surface on at least a part of the reflector portion in which there are alternately formed a plurality of light incidence sections into which the collimated light enters and a plurality of intermediate sections into which no collimated light enters; and at least a portion of the intermediate sections is formed from an irregular surface formed so as to recess rearward of the lamp with respect to a plane parallel to the direction of radiation of the collimated light.

2. The vehicle lamp according to claim 1, wherein the irregular surface has a saw-toothed cross-sectional profile.

3. The vehicle lamp according to claim 1, wherein at least a part of the reflection surface of the reflector portion is formed as an internal reflection section for reflecting the collimated light exiting from the optical member forward of the lamp through internal reflection; and each of the intermediate sections is formed from an irregular surface.

4. The vehicle lamp according to claim 1, wherein the light source is a LED light source.

5. The vehicle lamp according to claim 4, wherein the irregular surface has a saw-toothed cross-sectional profile.

6. The vehicle lamp according to claim 5, wherein at least a part of the reflection surface of the reflector portion is formed as an internal reflection section for reflecting the collimated light exiting from the optical member forward of the lamp through internal reflection; and each of the intermediate sections is formed from an irregular surface.

* * * * *